United States Patent [19]

Bouyoucos

[11] 4,187,917

[45] Feb. 12, 1980

[54] PILE DRIVER

[75] Inventor: John V. Bouyoucos, Rochester, N.Y.

[73] Assignee: Hydroacoustics, Inc., Rochester, N.Y.

[21] Appl. No.: 856,059

[22] Filed: Nov. 30, 1977

[51] Int. Cl.[2] ..... B25D 9/00

[52] U.S. Cl. ..... 173/131; 173/116; 173/139

[58] Field of Search ..... 173/116, 128, 131, 133, 173/139, DIG. 4; 91/4

[56] References Cited

U.S. PATENT DOCUMENTS

| | | | |
|---|---|---|---|
| 886,193 | 4/1908 | DeWitt | 173/131 |
| 1,039,369 | 9/1912 | Eichler | 173/131 |
| 2,373,972 | 4/1945 | Moreno | 173/139 X |
| 2,388,877 | 11/1945 | Souter | 173/116 X |
| 2,951,345 | 9/1960 | Lang | 173/131 X |
| 3,205,790 | 9/1965 | Bollar | 173/116 X |
| 3,250,335 | 5/1966 | Joelson | 173/116 X |
| 3,382,932 | 5/1968 | Wise | 173/135 |
| 3,498,391 | 3/1970 | Guild et al. | 173/131 |
| 3,570,609 | 3/1971 | Wise | 173/131 X |
| 3,595,324 | 7/1971 | Guild et al. | 173/131 X |
| 3,662,843 | 5/1972 | Wise | 173/131 |
| 3,797,585 | 3/1974 | Ludvigson | 173/131 |
| 3,897,835 | 8/1975 | Frederick | 173/131 |
| 4,121,671 | 10/1978 | West | 173/139 X |

FOREIGN PATENT DOCUMENTS

| | | | |
|---|---|---|---|
| 467165 | 10/1975 | U.S.S.R. | 173/116 |

*Primary Examiner*—Lawrence J. Staab
*Attorney, Agent, or Firm*—Martin LuKacher

[57] ABSTRACT

The driving power and driving rate of a pile driver hammer is increased without increasing the overall weight of the hammer through the use of a hydraulic spring transformer which is disposed between the ram and the pile in the housing of the hammer and presents a Q at the frequency where the mass of the ram and the stiffness of the hydraulic spring are in resonance which is less than about one.

14 Claims, 6 Drawing Figures

PILE DRIVER

The present invention relates to pile drivers and particularly to apparatus for transferring the force pulses developed by the pile driver ram to the pile.

The invention is especially suitable for use in providing a cap block arrangement in a pile driving hammer which is interposed between the ram and the pile to be driven. The cap block provides a transformer arrangement which enables a high velocity, low weight ram to appear to the pile as a low velocity, high weight ram, thereby minimizing impact stresses in the pile, while providing efficient transfer of energy to the pile. In addition, the cap block provides a spring, which together with the ram mass and transformer controls the duration of the force pulse. The combination spring-transformer enables the driving power delivered to the pile, in terms of the product of the blow energy and the repetition frequency of a ram, to be increased without increasing the force tending to lift the hammer off the pile, or increasing the impact stresses in the pile over those normally experienced in pile driving. The invention is also applicable to other types of impactors in addition to pile drivers where a tool receives impacts from an impacting member.

Pile driving is an empirical art. Certain combinations of blow energy and force pulse durations or widths (the period during which the driving force is applied to the pile) have been found to be preferred for general use in most soils and with most types of piles, including concrete, wood or mandrel driven corrugated piles. In order to increase the driving power, the repetition frequency of such blows must be increased. With increased repetition frequency, however, the weight of the hammer must be increased to compensate for the increased forces which tend to lift the hammer off the pile. In previous high frequency hammers, low blow energies were required in order to compensate for the lift-off effect. The reduced blow energy was unsuitable for many applications, such as soils other than those in which fluidization can occur and with larger piles. It is of course possible to increase the hammer weight. However, the weight of pile driving hammers is a critical factor in the stability of the cranes used to handle such hammers. As the hammer weight increases, the effect on the center of gravity of the crane and the crane stability relative to tipping increases. This may be compensated for either by a larger crane, or for a given crane size, by increased operator attention to stability. In either instance, increased weight reduces the mobility of the pile driver, increases the time for setting up the driver to drive each pile and consequently increases the cost of pile driving.

Some larger hammers also use very heavy rams and attempt to make the large blow energies produced effective over a long duration through the use of soft cushioning. As noted above, a hammer of very large size and weight is disadvantageous from the point of view of the lack of stability which it engenders in the cranes.

Various cushioning systems have been suggested for use in pile drivers. These involve air, mechanical or hydraulic springs (see U.S. Pat. Nos. RE 13,882, of Feb. 16, 1915; 886,193, of Apr. 28, 1968; 1,622,896, of Mar. 29, 1927; 3,446,293 of May 27, 1969; and 3,498,391 of Mar. 3, 1970). None of these systems has addressed the problem of increasing the repetition frequency or velocity of the blows, let alone how to avoid increasing the hammer weight at higher blow frequencies.

It has been found in accordance with the invention that, through the use of a hydraulic spring transformer in a pile driving hammer, the power and blow frequency of pile driving can be increased without changing the hammer weight or the individual blow characteristics (velocity and force level) as seen by the pile. Thus, blow energies and force durations that have worked satisfactorily in driving most types of pile can be used with higher blow repetition frequencies, without a concurrent requirement for increased hammer weight to maintain engagement with the pile. The blow energy may also be increased at somewhat reduced repetition frequency, again without requiring an increase in hammer weight. The hydraulic spring transformer enables a wide choice of force pulse duration; thus increasing the efficiency of driving the pile. The hydraulic spring is less lossy than the materials used in cap blocks, such as elastomeric material, air and mechanical springs. The hydraulic fluid can be circulated through the hydraulic spring to enhance heat transfer such that the hydraulic spring transformer can handle much higher power than can conventional cap blocks without deleterious effects.

In summary, the hydraulic spring transformer makes it possible for a lighter ram moving at higher velocity than normal to appear to the pile as a normal heavy ram moving at conventional low velocities, thereby retaining normal stress experience in the pile. However, the lighter, higher velocity ram makes possible, for a given hammer weight, higher blow frequency and, hence, higher pile driving power to be used, thereby providing increased pile driving performance.

Alternatively, through use of the spring transformer, the blow energy and the pile driver power can be increased without changing the hammer weight or the impact velocity as seen by the pile.

Furthermore, the hydraulic spring provides wide latitude in choosing spring rate or force pules duration to enable optimization of pile driving in given soil conditions. The low loss spring with provision for forced cooling enables higher power to be applied to the pile without damage to the cushion block.

Hydraulic transformers have heretofore been suggested for the purpose of transferring mechanical motion (see U.S. Pat. No. 3,516,052 issued June 2, 1970), and even in connection with pile pulling devices (see U.S. Pat. No. 2,951,345 issued Sept. 6, 1960). These hydraulic transformers have however not been designed to perform as hydraulic springs as well as transformers. Hydraulic springs and their design for use in rock drills has also been described (see U.S. Pat. Nos. 3,570,609 issued Mar. 16, 1971 and 3,382,932 issued May 14, 1968). The use of a hydraulic spring transformer in accordance with this invention provides the new and surprising resultof enabling the blow repetition frequency to be increased without requiring an increase in hammer weight to maintain the hammer in contact with the pile or a change from the preferred blow energy-force level characteristics; thus eliminating all of the disadvantages of high frequency, low blow energy hammers and large heavy hammers.

Accordingly, it is an object of this invention to provide improved impactors and especially improved pile drivers.

It is a further object of this invention to provide an improved means in a pile driver for transferring force pulses produced by ram impact events to the pile at high repetition rates withtout requiring increased hammer weight to maintain the hammer in contact with the pile.

It is a still further object of the present invention to provide an improved cap block for pile drivers.

It is a still further object of the present invention to provide an improved hydraulic pulse shaping spring for use in pile drivers.

It is a still further object of the present invention to provide an improved hydraulic transformer for use in pile drivers.

Briefly described, the invention as embodied in a pile driver, includes a pair of pistons which define a chamber therebetween. The chamber contains hydraulic fluid and the pistons are mounted in sliding relationship with the housing of the pile driving hammer. A first of these pistons receives impacts from the ram of the hammer and transfers the force pulses due to these impacts via the hydraulic spring to a second piston which in turn delivers the force pulses to the pile. The area presented to the chamber by the first piston is smaller than the area presented to the chamber by the second piston such that the pistons and the chamber provide a hydraulic spring transformer. The spring has a Q at the frequency where the spring is resonant with the mass of the ram and the other moving parts of the hammer, in the condition where the spring is loaded by the characteristic impedance of the pile, which is less than about one. The areas of the hammer are adjusted with respect to the blow energy and repetition frequencies required such that during the downward acceleration of the ram the hammer does not lift off the pile notwithstanding that the velocity of the ram and its repetition frequency may be increased above that which would ordinarily lift the hammer from the pile in a conventional pile driver. The liquid spring also shapes the force pulse so that its duration (width) is satisfactory for driving of most piles. The blow energy delivered is also of the magnitude which has been found satisfactory for general pile driving purposes. Accordingly, the repetition frequency is increased and the driving power delivered to the pile commensurately increased without a concurrent requirement for increasing the hammer weight in order to keep the hammer in contact with the pile.

The foregoing and other objects, features and advantages of the invention as well as a presently preferred embodiment thereof will become more apparent from a reading of the following description in connection with the accompanying drawings in which.

Figure 1:
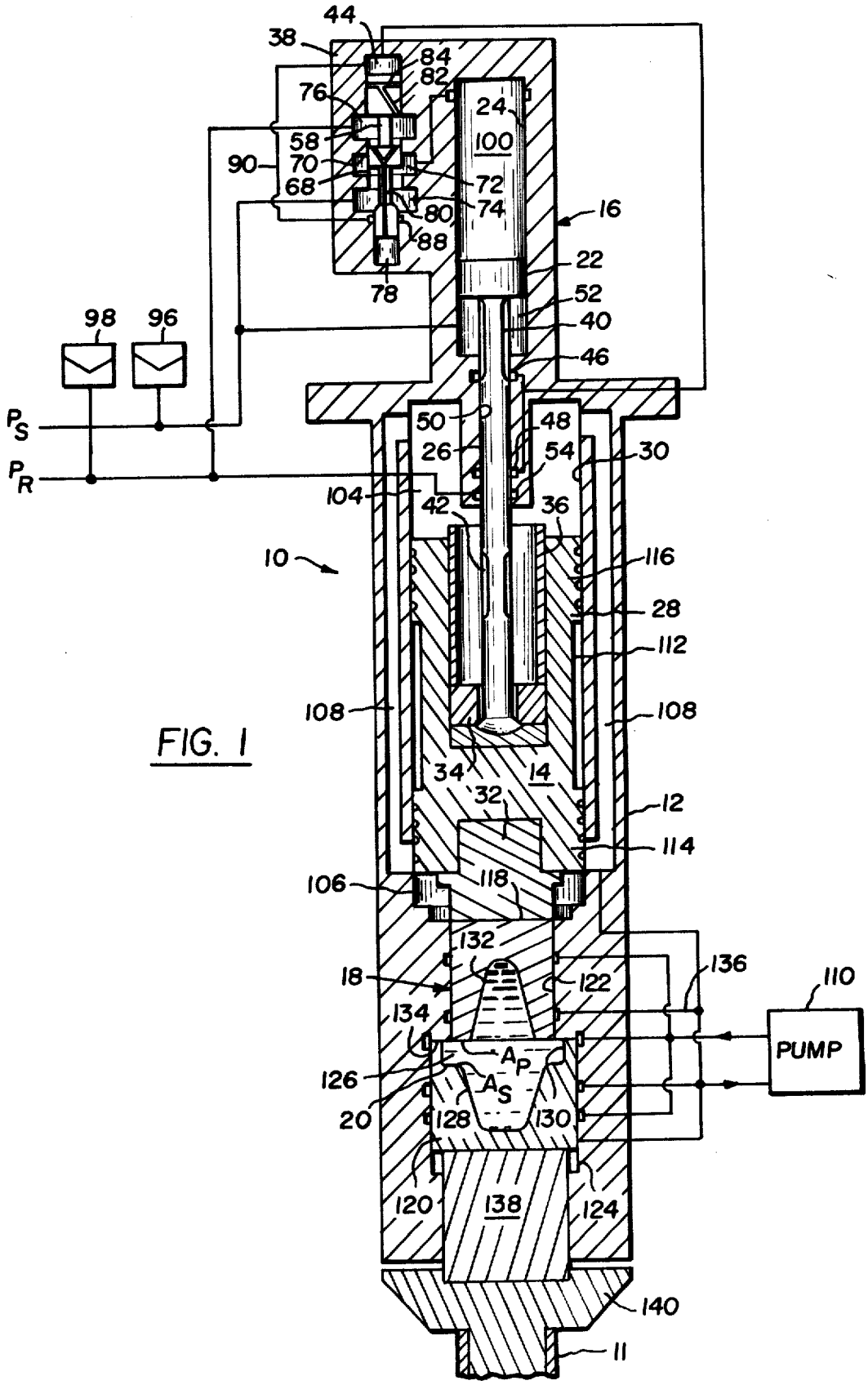
FIGS. 1 and 2 are simplified sectional views in elevation of a pile driving hammer embodying the invention during the driving and during the retracting portions of the cycle, respectively.
Figure 2:
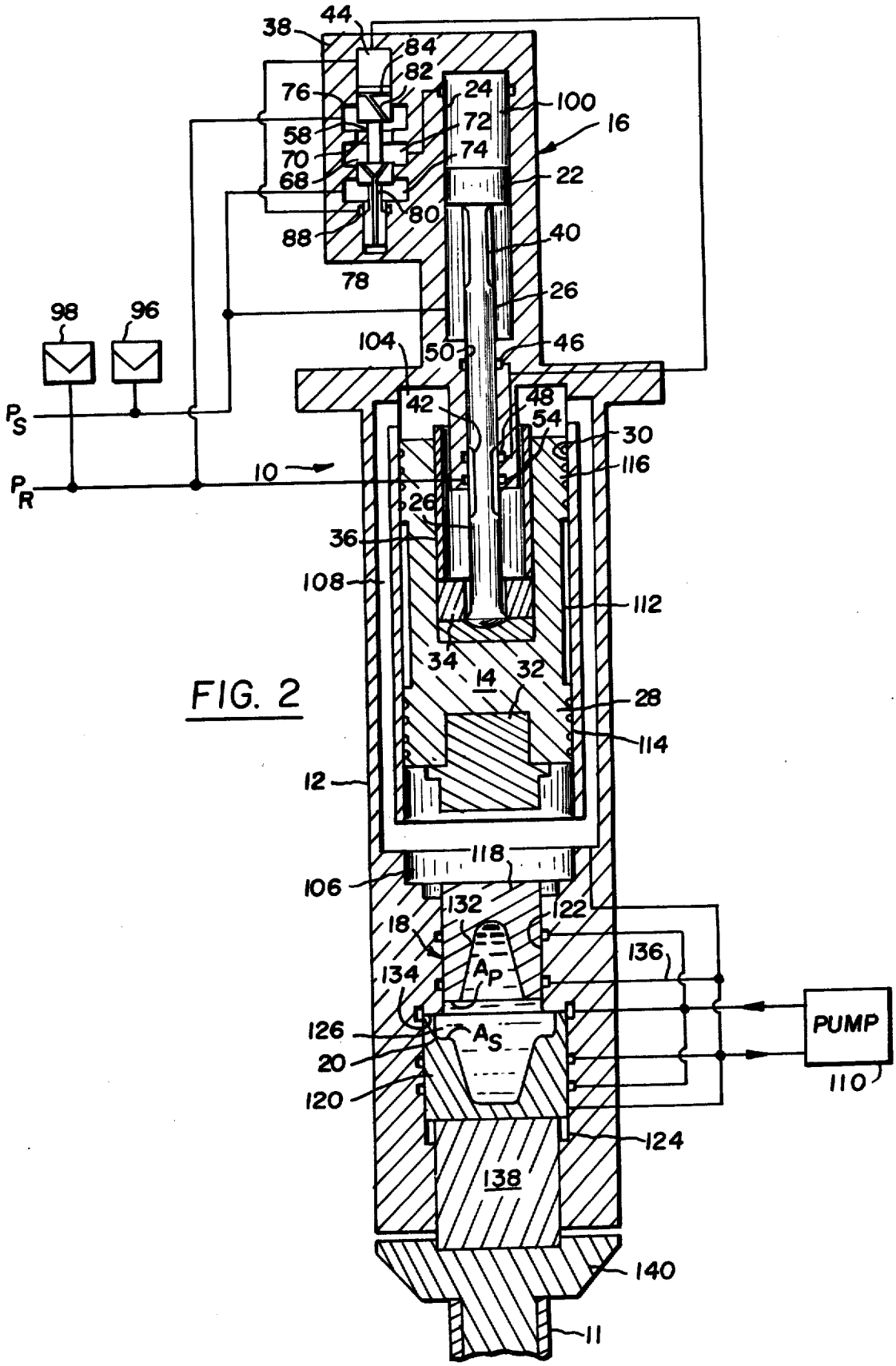

Referring first to FIGS. 1 and 2, there is shown a hydraulic pile driving hammer 10 disposed in driving position on the top of a pile 11. The pile may be a hollow member such as a step tapered pile. Other piles such as "H" piles or solid piles may be driven with the hammer 10. A housing 12 contains a ram assembly 14, a hydraulically operated oscillator 16, and a cap block assembly 18. A hydraulic spring transformer 20 is located in the cap block assembly 18. The housing may in practice be constructed in parts and with liners for ease of assembly. Prestressed cables and columns of the type conventionally used in pile driving hammers may assemble these parts together. The hammer may have a sheave assembly at its upper end. A crane may be used to pick up the hammer and associated leads. By moving the crane, the hammer and the leads may be moved from one pile driving location to another. A hydraulic power supply not shown, is provided, which may consist of a diesel engine, a pump and associated reservoirs and filters. The supply provides hydraulic fluid at elevated or supply pressure, indicated as $P_S$. The return pressure side of the supply at pressure $P_R$ may be connected to the reservoir.

By way of example, the hammer 10 may be designed to deliver impact energy rates at 32,500 ft. lbs. The length of the hammer may typically be about 16 ft., with the diameter across the housing 12 being about 3 ft. The weight of the hammer may be about 20,000 lbs, and the weight of the ram may be about 3000 lbs. The ram impact velocity may be 26 ft/sec. The spring transformer can make the ram appear to the pile as weighing 9000 lbs effectively, impacting at an effective velocity of 15 ft/sec. The hydraulic spring transformer 20 and the associated lightweight ram system enables the blow frequency to be about 200 blows per minute. At this blow energy and frequency, under normal circumstances, (9000 lb ram impacting at 15 ft/sec) the hammer weight which would be required to maintain the hammer engaged with the pile would be about 40,000 lbs. Thus, with the use of the hydraulic spring transformer and associated lightweight ram, the hammer weight has been reduced by a factor of about 2. The hydraulic spring transformer makes the lightweight ram travelling at high velocity appear to the pile like a large heavy ram travelling at low velocity. The lightest weight and highest velocity commensurate with the life and reliability of the striking system can therefore be used in a pile driving hammer embodying the invention.

The hydraulic oscillator consists of an actuating piston 22 which reciprocates in a cylinder 24 provided by a bore in the upper end of the housing 12. A rod 26 connects the piston 22 to the ram assembly 14. This assembly includes a ram 28 which has a sliding fit within a cylinder 30 provided by a bore in the housing 12. A ram point 32 is provided at the lower end of the ram to take the impact stresses when the ram strikes at the end of the forward stroke of the ram. The piston rod 26 is attached to the ram by means of locking discs 34, which are held in place by a retainer cylinder 36. This cylinder 36 may be threaded into the ram 28. The hydraulic driver 16 incorporates a valve 38. Upper and lower flats 40 and 42 on the piston rod 26 actuate the valve 38 by supplying pressurized hydraulic fluid at supply or return pressure via upper and lower trip ports 46 and 48 to a control chamber 44 at the upper end of the spool 58. These trip ports may be grooves in a bore 50 in the housing in which the piston rod 26 reciprocates. The upper flats 40 connect a lower chamber 52 in the cylinder 24 to the upper trip port 46 at the end of the forward stroke of the ram. A peripheral groove 54 located below the lower trip port 48 in the bore 50 provides a return port which is connected continuously to return $P_R$. The lower flat 42 connects this return port (the groove 54) to the lower trip port 48 during and suitably at the middle of the return stroke of the ram, as may be observed from FIG. 2.

Figure 4:
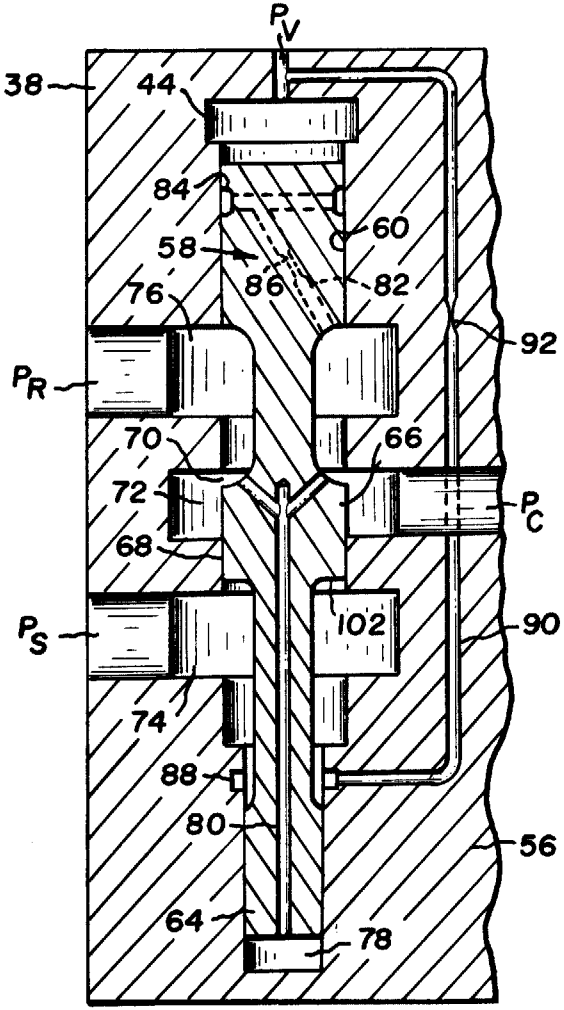
FIGS. 3 and 4 are an enlarged sectional view of the control valve of the hammer shown in FIGS. 1 and 2 in the positions which the valve achieves during the driving and during the retracting portions of the cycle respectively.
Figure 3:
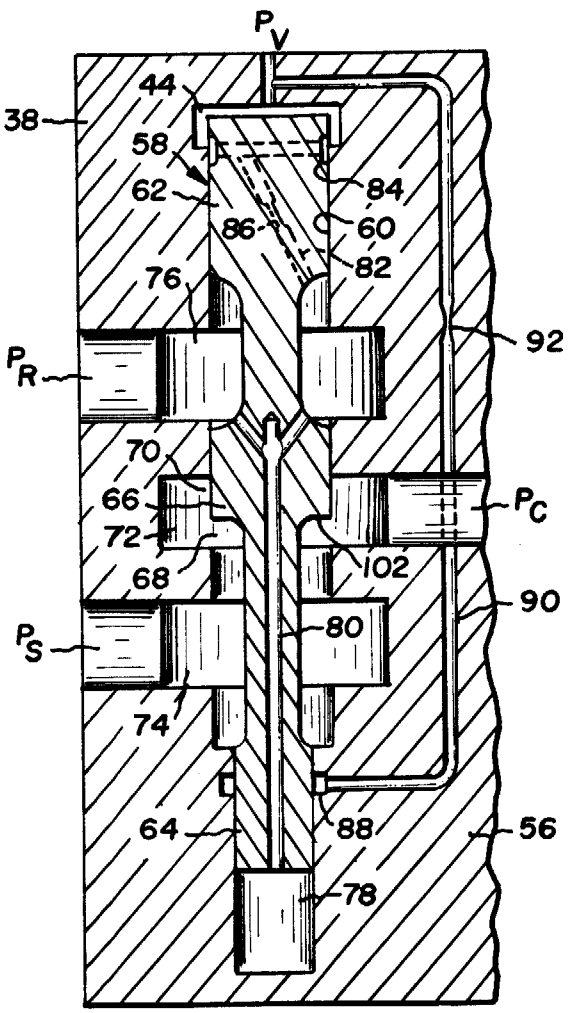

As may be observed also in FIGS. 3 and 4 the valve 38 has its own housing 56 which may be separate from and attached to the housing 12, although shown integral with the housing 12 in FIGS. 1 and 2. A spool 58 has a sliding fit in a bore 60 in the valve housing 56. The upper end 62 of the spool is of larger diameter than the lower end 64 thereof. A central land 66 of the spool 58 defines supply and return switching ports 68 and 70 with the lower and upper edges of a central groove 72 in the bore 60. When the supply port 68 is open, the central groove 72 is connected to a lower groove 74 in the bore 60. When the return port 70 is open, the central groove 72 is connected to an upper groove 76 in the bore 60.

A chamber 78 at the lower end of the valve is continuously connected to the region defined by the upper groove 76 by channels 80 extending through the spool 58

The valve 38 has means for latching itself in the upper position as shown in FIG. 3 with the port 68 open, or in the position shown in FIG. 4 with the port 70 open. The valve 38 in operation is a bi-stable device. The valve is latched in the upper position by means of a passageway 82 between a peripheral groove 84 near the upper end of the valve and the region of the groove 76. The groove 84 is open to the upper end chamber 44 when the spool 58 is in the upper position, as shown in FIG. 3. When the spool is in the lower position, as shown in FIG. 4, the groove 84 is closed by the bore 60 from the upper end chamber 44. The latching passageway 82 is restricted as by being narrow or by being formed with an orifice 86. By restricted is meant that the passageway 82 provides a much narrower path for fluid than is provided by the switching ports 68 and 70. The passageway 82 is sufficiently large to make up for leakage paths around the periphery of the spool and the bore 60 and around the piston rod 26 and in its bore 50, which would otherwise allow the spool 58 to drift.

The groove 84 acts as a latching port when the spool is in its upper position, shown in FIG. 3. Another groove 88 provides another latching port which is operative to latch the valve with the spool 58 in the downward position, shown in FIG. 4. This groove 88 is in the periphery of the bore 60 and is opened and closed by the lower end 64 of the spool 62. Another latching passageway 90 which is also restricted, as by an orifice, connects the latching port 88 to the upper end chamber 44. This latching passageway 90 is restricted relative to the switching ports 68 and 70 but is sufficiently large relative to the possible leakage paths as may exist between the periphery of the spool 58 and the bore 60, so as to prevent drifting of the spool 58.

The hydraulic circuit of the driver 16 includes accumulators 96 and 98 connected to the supply and return lines from the hydraulic power system. These accumulators smooth the pressure fluctuations in the system which are presented to the hydraulic power supply, and may be the type using pressurized gas biased diaphragms or pistons.

The piston 22 divides the cylinder into the lower chamber 52 and an upper chamber 100 which may be referred to as the active chamber. The pressure in this chamber 100 is switched between supply and return pressure by the valve 38. The upper area of the piston 22 which faces the active chamber 100 is larger than the lower area which faces the chamber 52. The effective areas are those presented in a plane perpendicular to the axis of the piston which is the axis along which the piston moves. The upper area of the piston 22 may suitably be twice that of the lower area. The lower chamber 52 is always connected to supply pressure, $P_S$. When the active chamber 100 is connected to supply pressure, there is a force of magnitude $P_S(A_U-A_L)$ urging the piston 22 and the ram assembly 14 which is connected thereto, downward. $A_U$ is the upper area of the piston 22 and $A_L$ is the lower area thereof. When the active chamber 100 is connected to return pressure $P_R$ there is a hydraulic force of magnitude $P_SA_L-P_RA_U$, directed upwardly. This upward hydraulic force moves the piston 22, the rod 26 and the ram assembly 14 upwardly away from the pile 12.

Supply pressure, $P_S$, is connected to the cavity defined by the lower groove 74 in the valve bore 60. Return pressure $P_R$ is applied to the upper groove cavity 76. The active chamber 100 is connected to the central chamber 72. The pressure in the active chamber, shown as $P_C$ in FIGS. 3 and 4, is switched by the valve between $P_S$ and $P_R$. With the spool 62 in the upper position, as shown in FIGS. 1 and 3, the supply switching port 68 is open. This applies supply pressure $P_S$ to the active chamber 100 as shown in FIGS. 1 and 3. With the spool 58 in the lower position, as shown in FIGS. 2 and 4, the return switching port 70 is open. This applies return pressure $P_R$ to the active chamber 100.

The position of the valve spool 58 is controlled by the position of the ram 28. When the ram and the piston rod 26 approach the bottom of the forward stroke, the upper flats 40 reach the position shown in FIG. 1, which is the position of the ram just before impact. At impact, the connection is made by way of the flats 40 between the lower chamber 52 and the upper trip port 46. The hydraulic fluid at supply pressure from the lower chamber 52 then flows into the upper end chamber 44 of the valve 38. The lower chamber 78 is maintained at return pressure since it is connected to the upper cavity 76 which in turn is connected to the return side of the hydraulic power supply at $P_R$. The net hydraulic force on the spool 58 moves the spool downward from the position shown in FIGS. 1 and 3 to the position shown in FIGS. 2 and 4. The switching port 68 closes while the switching port 70 opens and the pressure in the upper chamber is switched to return.

The ram 28 then moves upwardly until the lower flats 42 connect the lower trip port 48 to return via the porting groove 54. Return pressure is then switched to the upper end chamber 44 of the valve 38. Supply pressure is always applied to the step 102 of the central land of the spool 58. The net hydraulic force on the spool 58 is therefore in the upward direction. The spool moves upwardly from the position shown in FIGS. 2 and 4 to the position shown in FIGS. 1 and 3. The active chamber 100 is connected to supply pressure.

Figure 5:
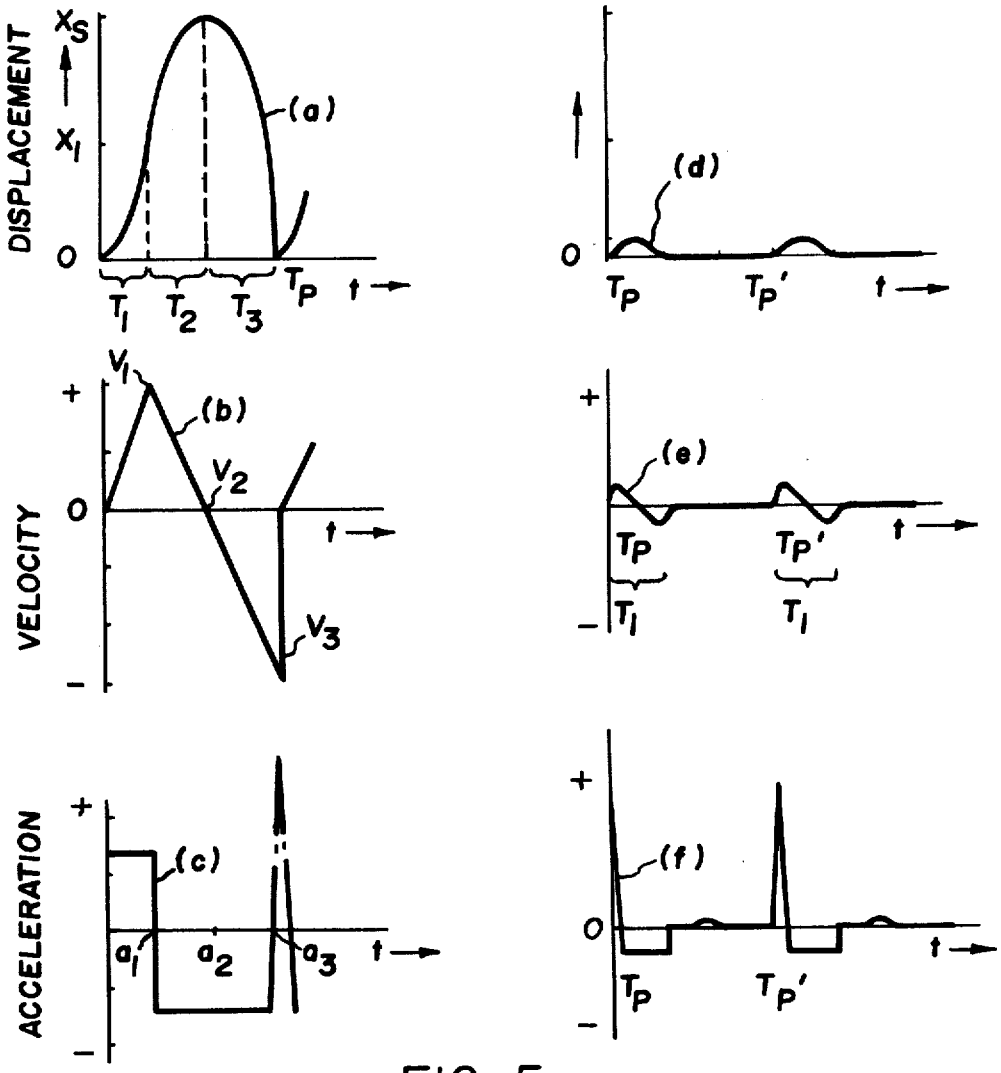
FIG. 5 are waveforms illustrating the motion history of the ram and housing of the hammer shown in FIGS. 1 and 2.

The downward hydraulic force on the piston 22 first decelerates the upward motion of the ram assembly 14. The ram eventually reaches zero velocity at the end of the retraction or return stroke. Then the ram is accelerated downward to impact the pile 11 via the hydraulic spring transformer 18. The lower flats 42 are positioned to actuate the valve 38 so as to switch the active chamber 100 from return to supply pressure suitably at a point midway in the return stroke of the ram. This is the "symmetrically switched" case, and results in a motion history which is shown in FIG. 5.

When the valve spool 58 is driven downwardly, to switch the pressure in the active chamber 100 from supply to return, latching port 88 is opened to the lower cavity 74 which is always at supply pressure, $P_S$, (see FIG. 4). Supply pressure is then applied, via the passageway 90 having the restriction 92 to the upper end chamber 44 and latches the spool in downward position. The spool remains latched until the valve is tripped when the control pressure, indicated at $P_V$ in FIG. 4 is switched from supply to return pressure $P_R$ via the return porting groove 54, the lower flats 42 and the lower trip port 48. The spool 58 is then driven to the upper position, shown in FIG. 3 and the lower latching port 88 is closed.

The upper latching groove 84 connects the cavity 76 to the upper end chamber 44, via the restricted passageway 82. The upper end chamber 44 is maintained at return pressure, and the valve 38 is latched with the spool 58 in its upward position until it is tripped at the end of the downward stroke of the ram by the upper flats 40 and the upper trip port 46.

Because the flow through the restricted passageways 82 and 90 makes up for leakage into or out of the upper end chamber 44, the valve is latched and does not drift. There are no positions of stability of the spool 58 other than the position at the top of the valve spool travel shown in FIG. 3 or at the bottom of the valve spool travel shown in FIG. 4. The hydraulic oscillator provided by the piston 22, the piston rod 26, the valve 38 and its hydraulic circuitry will start up and begin oscillating as soon as the pressurized fluid is applied to the hammer. Even at the relatively long intervals between switching of pressure, the valving is positive and inopportune switching is obviated. Another advantage of the hydraulic driver is that it is entirely hydraulically actuated, and cams or other mechanical actuators which move up and down with the ram are not needed. The reliability of the driver even with high frequency pile driving, say, at 200 blows per minute, is much improved over mechanical valve actuation. Simplifications in valve design are also obtained since the effect of leakage in the valve are counteracted without the need for special seals.

Another advantage of the hydraulic driver is that additional ram length is not required to accommodate trip ports in the hammer housing and on the ram. The portion of the housing containing the bore 50 in which the trip ports 46 and 48 and the porting groove 54 are located is of a diameter less than the diameter of the retainer cylinder 36. The total length which is necessary for switching the valve control pressure $P_v$ is one half the stroke length, where switching occurs at the middle of the return stroke. This length is in part accommodated by an extension of the housing portion which contains the bore 50 into which the ram may fit.

Various modifications in the hydraulic oscillator may be made. For example the upper trip port 46 may be eliminated if the upper flats 40 are lengthened; however, this will cause the overall length of the hammer to increase.

The cylinder 30 in the housing 12 in which the ram 24 reciprocates is primarily air filled. The regions 104 and 106 and the opposite ends of the bore are interconnected by passages 108 which may be in the form of a gallery with radial holes at the opposite ends thereof into the regions 104 and 106. The air-filled bore or cylinder 30 minimizes losses as the air is allowed to circulate through the passageway 108 between the air-filled regions 104 and 106. Oil is allowed to leak into the ram cylinder 30. Such leakage is downwardly in the bearing between the piston rod 26 and the bore 50. Hydraulic oil also leaks upwardly into the cylinder 30 from the hydraulic spring transformer 20. The oil level at the bottom of the cylinder 30 (viz., in the region 106) is maintained by means of a pump 110 which supplies pressurized hydraulic fluid for the hydraulic spring transformer. This pump 110 may be a separate scavenging pump. Alternatively, the main hydraulic supply may be used with a pressure regulator to reduce the pressure for the hydraulic spring transformer and the bearings at the lower end of the hammer. The residual oil in the lower region 106 has the advantage of providing a dash pot damper which can absorb the ram energy in the event of the pile running. The ram may have a central groove 112 which defines bearing areas of lands 114 and 116. These lands contain grooves which serve as oil reservoirs and dirt collectors.

The hydraulic spring transformer consists of an upper piston 118 and a lower piston 120 which are slidably mounted in bores 122 and 124 in the housing. These pistons 118 and 120 are centered in their bores 122 and 124 as by tapered hydrostatic bearings which are fed from the pump 110. A chamber 126 is defined in the housing between the opposed ends of the transformer pistons 118 and 120. The lower piston 120 has a generally concave opening 128. The upper portion of this opening 128 is a bore 130 having a diameter slightly larger than the diameter of the upper piston 118. A generally concave opening is also formed in the lower end of the upper piston 118. The upper piston 118 can move upwardly and downwardly. The lower piston 120 can move downwardly. Its upper motion is stopped by a step 134 in the housing 12. The chamber 126 is therefore a variable volume chamber. This chamber is filled with hydraulic oil under pressure which is supplied by the pump 110. The volume of liquid in the chamber 126 forms a hydraulic spring. The hydraulic oil circulates through the spring which serves to replenish any liquid loss through leakage and to cool the hydraulic spring transformer assembly 18.

Between impact events (after each blow), the upper piston is forced upwardly, which uncovers a port to a return line 136 to the pump 110. This limits the pressure in the hydraulic spring chamber 126 to a given low value between blows (the return pressure of the pump 110), and insures the flow through the spring chamber 126, which replenishes the liquid and cools the assembly 18.

The lower end of the upper transformer piston 118 presents an area indicated as $A_P$ to the spring chamber 126 in a plane perpendicular to the direction of movement of the pistons (viz., the common axis of the pistons 118 and 120 and the bores 122 and 124 in the housing 12). The lower piston 120 presents an area to the spring chamber 126, indicated as $A_S$, in a plane perpendicular to the direction of motion of the pistons. The area of the lower piston $A_S$ is generally larger than the area $A_P$ of the upper piston. The blow energy is porportional to the product of the mass of the ram and the square of the velocity of the mass at impact. For example, it will be shown that a transformation ratio of $A_S/A_P$ of 2:1 enables the ram mass to be reduced by a factor of about 4, while increasing the ram impact velocity by a factor of about 2 to maintain fixed blow energy and fixed velocity as seen by the pile. Such a lighter ram is of course much easier to turn around and cycle at higher repetition frequencies than the heavier ram of four times the mass, while maintaining a fixed chamber weight.

The duration of the force pulse which is transmitted to the pile is controlled by the ram mass and the volume of the hydraulic fluid in the spring chamber 126. The spring chamber volume may be designed to provide a force pulse duration which has been found to be satisfactory for pile driving.

The lower hydraulic spring transformer piston 120 is in contact with a solid block 138 which aligns the lower piston 120 with an adapter 140. The adapter 140 connects the lower end of the hammer to the pile 12. This block 138 may be of hard wood such as oak, or may be of aluminum.

Consider the cycle of motion for the ram 28 driven by the hydraulic driver 16 with its differential area piston 22 as shown in FIGS. 5(*a*), (*b*), and (*c*). Over the time interval $T_1$ the ram 28 is accelerated upward with a force $F_R$, to reach a position $X_1$. During the interval $T_2$ the force $F_R$ switches sign ($-F_R$), causing the ram to decelerate to zero velocity at the upper end of its stroke at a position $X_S$ above the striking point where the motion of the ram is arrested by the hydraulic spring transformer (viz., the impact position). Consider that the value of $X_S$ is twice $X_1$ which is the symmetrical switched force case. The distance to the top of the stroke $X_S$ from $X_1$ is $X_2$. During interval $T_3$ the ram accelerates downward over the stroke $X_S$ to impact at a velocity $V_3$ at the impact position.

For constant applied force, $F_R$, on the ram 28 (which is opposed by an equal force on the housing) the ram velocity V(t) is $$V(t)=(F_R/M_R)t \tag{1}$$

where $M_R$ is the ram assembly 14 mass. The impact velocity $V_3$ is obtained in the acceleration time $T_3$ where $$T_3=M_RV_3/F_R \tag{2}$$

The position of the ram as a function of time is governed by the equation $$X(t)=\tfrac{1}{2}(F_R/M_R)t^2+V_0t+X_0 \tag{3}$$

At end of the time interval $T_1$ the ram reaches the position $X_1$, where $$X_1=\tfrac{1}{2}(F_R/M_R)T_1^2 \tag{4}$$

For the symmetrical switched force case, $$X_1=X_2=X_S/2 \tag{5}$$

where $$X_S=\tfrac{1}{2}(F_R/M_R)T_3^2 \tag{6}$$

The times $T_1$, $T_2$ and $T_3$ are $$T_1=\sqrt{\frac{2M_R}{F_R}X_1}=\frac{1}{\sqrt{2}}\sqrt{\frac{2M_R}{F_R}X_S}= \tag{7}$$

-continued $$T_2;\ T_3=\sqrt{\frac{2M_R}{F_R}X_S}$$

Also, the repetition period 0 to $T_P$ is $$T_P=T_1+T_2+T_3=(2/\sqrt{2}+1)T_3$$

or $$T_P=2.414T_3=1/f_R \tag{8}$$

where $f_R$ is the repetition frequency.

Combining equations (2) and (8)

$$1/f_R=2.414(M_RV_3/F_R) \tag{9}$$

or $$F_R=2.414M_RV_3f_R \tag{10}$$

The blow energy $E_B$ is $$E_B=\tfrac{1}{2}M_RV_3^2 \tag{11}$$

Equation (10) can further be expressed as $$F_R=4.828(E_Bf_R/V_3)=F_H \tag{12}$$

where $F_H$ is the equal but opposing force on the housing (viz., on the hammer 18 as a whole).

Equation (12) states that the dynamic force on the housing tending to lift it off the pile is proportional to the driving power $E_B \cdot f_R$ and is inversely proportional to the velocity of ram impact, $V_3$. If the housing is not to lift off the pile, the upward force, $F_H$, on the housing must obey the relationship $$F_H \leqq M_Hg \tag{13}$$

where $M_H$ is the total hammer mass and g is the acceleration of gravity. From Eqs. (12) and (13), for a given hammer mass, the only way to increase the driving power, the product of $E_B$ and $f_R$, is to increase the impact velocity.

However, an increase in impact velocity, if applied directly to the pile, would lead to higher stresses in the pile which might damage the pile or require more costly pile structures. The interposition of the hydraulic transformer between the ram and the pile enables the high ram velocities to be used at the input to the transformer, while at the output of the transformer, the pile can experience the same velocities customarily used in effective pile driving. Thus, with reference to FIGS. 1 and 2, if $A_P$ is the cross-sectional area of the upper impact receiving piston 118 of the spring transformer, and if $A_S$ is the cross-sectional area of the lower piston 120 which is direct coupled to the pile, to an approximation $$V_3'=(A_P/A_S)V_3 \tag{14}$$

where $V_3'$ is the velocity of the lower piston 120 and $V_3$ is the velocity of the ram at impact with the upper piston 118. Also, to an approximation, the effective mass of the ram, $M_{R_{eff}}$ as seen by the pile, is $$M_{R_{eff}}=(A_S/A_P)^2M_R \tag{15}$$

where $M_R$ is the actual ram mass.

Since the blow energy available upon impact is $$E_B = \tfrac{1}{2} M_R V_3^2, \tag{16}$$

from the pile interface looking back, using equations (14) and (15), $$E_B = \tfrac{1}{2}(A_P/A_S)^2 M_{Reff}((A_S/A_P)V_3')^2$$

$$E_B = \tfrac{1}{2} M_{Reff}(V_3')^2 \tag{17}$$

Thus, equations (16) and (17) state that the effect of the hydraulic transformer is to make a low mass ram, $M_R$, impacting at high velocity, $V_3$, appear to the pile as a high mass ram, $M_{Reff}$, travelling at the relatively lower velocity, $V_3'$. Thus, the pile will exhibit a normal stress experience while the hammer design can benefit from the advantages of a high velocity, low mass ram.

An additional constraint on hammer weight is that the average of the force applied to the pile must be less than the hammer weight. Consider, for example, half-sinusoid force pulses. The average of these pulses, $\bar{F}_P$, is $$\bar{F}_P = (2/\pi)\hat{F}_P T_D f_R \tag{18}$$

where $\hat{F}_P$ is the peak amplitude, $T_D$ the time duration, and $f_R$ the repetition frequency of the pulses. The energy delivered to the pile $E_B'$, is given by $$E_B' = \tfrac{1}{2}(\hat{F}_P^2/R_{LM})T_D \tag{19}$$

where $R_{LM}$ is the load resistance which may be the characteristic mechanical impedance of the pile.

Combining equations (18) and (19) yields $$\bar{F}_P = (4/\pi)E_B'(R_{LM}/\hat{F}_P)f_R \tag{20}$$

or $$\bar{F}_P = (4/\pi)(E_B' f_R/V_3') \tag{21}$$

where $$V_3' = \hat{F}_P/R_{LM} \tag{22}$$

and is the velocity of the lower hydraulic spring transformer piston 120, which velocity is seen by the pile.

Equation (21) is the same form as equation (12) but may involve different energies and different velocities. Specifically $E_B$ may not equal $E_B'$ if significant rebound exists, and $V_3$ may not equal $V_3'$, especially in the presence of the hydraulic transformer. However, equation (21) does define an average force $\bar{F}_P$ which, with the insertion of the appropriate values of $E_B'$ and $V_3'$, defines a minimum value for the combined weight of the housing and ram (plus any pull down) for which the hammer will remain in engagement with the pile.

Generally, in pile drivers Eq. (12) will be found to be a more severe constraint on hammer weight than Eq. (21), implying that the reaction force on the housing from driving the ram to impact has more of a tedency to lift the hammer off the pile than does the reaction from the average of the force pulses applied to the pile.

Figure 6:
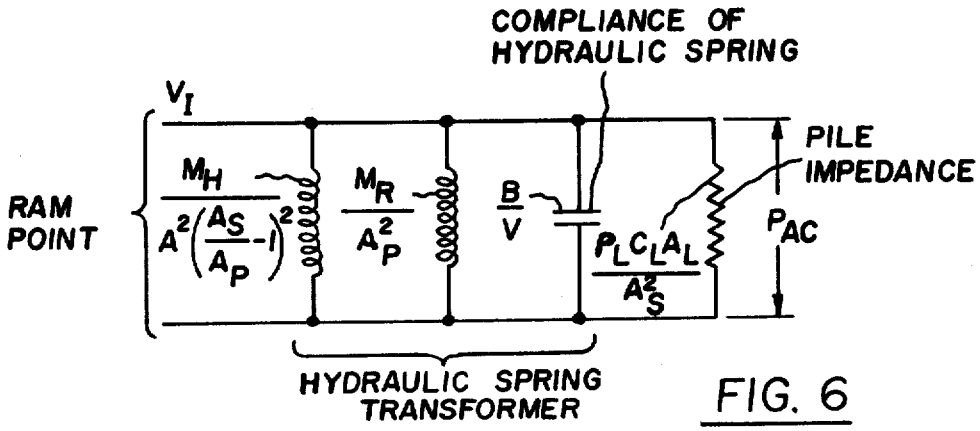
FIG. 6 is a simplified schematic diagram of the equivalent circuit of the hammer during impact of the ram with the hydraulic spring transformer looking into the hydraulic spring transformer from the ram point.

For a more detailed view of the factors affecting operation, consider the equivalent circuit of the hydraulic spring transformer shown in FIG. 6.

The impact velocity $V_3$ may be expressed as $$V_3 = (P_{AC}/Z_{AP}A_P) \tag{23}$$

where $P_{AC}$ is the pressure in the spring chamber 126 and $Z_{AP}$ is the acoustic impedance seen by the area $A_P$ of the impact piston looking into the spring chamber. $Z_{AP}$ can be expressed as the parallel combination of the acoustic load impedance, transformed through the pile piston, the mass reactance of the housing, and the compliance reactance of the spring chamber 126 at resonance, as shown in FIG. 6 as follows:

$$Z_{AP} = \frac{R_{AP}}{1 - jQ\left[\dfrac{1}{1 + \dfrac{M_R}{M_H}\left(\dfrac{A_s}{A_p} - 1\right)^2}\right]} \tag{24}$$

where $R_{AP} = P_L c_L A_L / A_S^2$, $Q = R_{AP} W_P C$, $C = V/B$, $$\omega_p^2 = \frac{B}{V}\,\frac{A_p^2}{M_R}\left[1 + \frac{M_R}{M_H}\left(\frac{A_s}{A_p} - 1\right)^2\right] \tag{25}$$

$A_L$ is the area presented by the pile to the housing, $\omega_P$ is the resonant frequency in radians per second. B is the bulk modulus of the liquid in the spring chamber 126, $P_L$ is the density of the pile, $c_L$ is the velocity of sound in the pile, V is the hydraulic spring chamber 126 volume, and Q is the quality factor of the load.

Combining equations (23) and (24)

$$V_3 = (P_{AC}/R_{AP}A_P)(1 - jQ') \tag{26}$$

where $$Q^1 = Q\left[\frac{1}{1 + \dfrac{M_R}{M_H}\left(\dfrac{A_s}{A_p} - 1\right)^2}\right]$$

Also $$V_3' = (P_{AC}A_S/P_L C_L A_L) = (P_{AC}/R_{AP}A_S) \tag{27}$$

From Equations (27) and (26) the ratio $V_3/V_3'$ is $$V_3/V_3' = (A_S/A_P)(1 + Q'^2)^{\frac{1}{2}} \tag{28}$$

Returning now to equation (21) we may write $$\bar{F}_P = (4/\pi)(E_B' f_R/V_3)\cdot(A_S/A_P)(1 + Q'^2)^{\frac{1}{2}} \tag{29}$$

If, $Q \leqq 1$ so that rebound is minimized, then $E_B = E_B'$, and equation (29) reduced to $$\bar{F}_P = (4/\pi)(A_S/A_P)(E_B f_R/V_3) \tag{30}$$

$\bar{F}_P$ represents the average of the force pulses on the pile that must be met or exceeded by the total weight of the hammer in order for the hammer to remain in engagement with the pile.

From equation (28) it can be seen that it is important for Q to be small in order that the average of the force pulses be minimized, thereby minimizing hammer weight requirements. A low value of Q is also generally associated with higher energy transfer efficiency from the ram to the pile. The value of Q chosen in design is determined in part by the shape of the force pulse desired for effective pile driving.

A balance between the two major forces tending to lift the hammer off the pile is obtained approximately by equating equations (12) and (28). For the case that $Q<1$, $M_R << M_H$, this balance results in the expression $$A_S/A_P \sim 1.2\pi \quad (31)$$

Thus, for values of $A_S/A_P<\pi$, the principal force tending to lift the hammer off the pile is the reaction force from accelerating the ram toward impact.

Referring back to equations (12), an increase in $V_3$ of about three (i.e., $\pi$) with the same blow energy enables the blow repetition frequency to be increased approximately threefold, thereby increasing the pile driving power and the penetration rate by comparable amounts, without the need to increase the total hammer weight. Alternatively, for the same repetition frequency, the hammer weight could be substantially reduced.

In practice, some excess weight over the compensating forces may be desirable to achieve consistently smooth operation. Under these circumstances it should be possible to realize a 2 to 3 fold improvement in power transfer for the same total hammer weight.

As observed from FIGS. 5(*b*) and 5(*c*), when the ram reaches the impact point its velocity is arrested and its acceleration is reversed. An impulse of magnitude equal to the momentum of the ram, $M_RV_3$, is imparted to the upper piston of the spring transformer. A larger impulse, $M_RV_3(A_s/A_p)$ is imparted to the pile and an upward impulse, $M_R((A_s/A_p)-1)$ is imparted to the hammer, tending to displace it upward as shown in FIG. 5(*d*).

However, at the instant that the displacement occurs, the force on the ram is reversed due to the switching of the pressurized fluid from supply to return. In the upper chamber 100 of the hydraulic driver 16, the flats 40 on the piston rod 26 actuate the value 38 to reverse the pressure in the chamber 100. An upward accelerating force on the ram is then applied for the time interval $T_1$. During this time the hammer has applied to it a downward force which arrests the upward velocity of the hammer as shown in FIG. 5(*e*). When this force is again switched after time $T_1$, the hammer continues to move at constant velocity towards the pile and shortly reaches the pile, where is remains until the ram finishes repeating its cycle as shown in FIG. 5(*e*). Therefore, there is only a very short acceleration of the hammer away from the pile as shown in FIG. 5(*f*) which occurs after the hammer has accelerated to the impact position and the blow has been imparted to the pile.

From the foregoing description it will be apparent that there has been provided an improved impactor and particularly an improved pile driving apparatus. Variations and modifications of the herein described apparatus within the scope of the invention will undoubtedly become apparent to those skilled in the art. Accordingly, the foregoing description should be taken as illustrative and not in any limiting sense.

What is claimed is:

1. In a pile driver having a housing adapted to be placed upon the pile to be driven, a ram mounted for reciprocating movement in said housing with means for repetitively driving said ram in forward and return strokes toward and away from said pile, apparatus which permits the ram weight to be reduced, the ram velocity to be increased and the driving power applied to the pile, expressed as the product of the blow energy and repetition frequency of the ram, to be increased without increasing the force tending to lift the housing off the pile during the downward acceleration of said ram, said apparatus comprising a hydraulic spring-transformer disposed in said housing between said ram and said pile for receiving repetitive impacts from said ram and transferring force pulses due to said impacts to said pile and for transforming the higher impact velocity of said ram to a lower impact velocity as imparted to said pile, said hydraulic transformer comprising a first piston and a second piston which define a variable volume chamber, said chamber containing hydraulic fluid and providing said hydraulic spring, said first piston being disposed adjacent said ram for receiving said impacts therefrom and said second piston being disposed between said first piston and said pile for transferring said impacts received from said first piston via said hydraulic spring to said pile, said chamber having such a volume that the Q of said spring, loaded by the characteristic impedance of the pile, is less than about 1 where $$Q=R_{AP}\omega_P C,$$

and $$R_{AP}=(P_L c_L A_L/A_S^2)$$

where $P_L$ is the density of the pile, $c_L$ is the velocity of sound in the pile, $A_L$ is the area presented by the pile to the housing, and $A_S$ is the said area presented by said second piston to said chamber, $$C=V/B,$$

where

V is the volume of the chamber and B is the bulk modulus of the hydraulic fluid in said chamber, and $\omega_P$ is the resonant frequency in radians per second where $$\omega_P^2=(B/V)(A_P^2/M_R[1+(M_R/M_H)(A_S/A_P-1)^2]$$

where $A_P$ is said area presented by said first piston to said chamber, $M_R$ is the mass of the ram and $M_H$ is the mass of the housing.

2. The invention as set forth in claim 1 wherein the area of said first piston in a plane perpendicular to the direction of transmission of said force pulses presented to said chamber is less than the area in said plane presented to said chamber by said second piston.

3. The invention as set forth in claim 2 wherein said chamber is formed by a concave opening into at least one of said pistons, one of said pistons being smaller in cross section than the other of said pistons, and said other of said pistons having a bore into which said one piston is movable and is received in sliding relationship.

4. The invention as set forth in claim 3 wherein both of said first and second pistons are cylindrical in shape, said one piston being of smaller diameter than the said other piston, said bore being of diameter slightly larger than the diameter of said one piston to receive said one piston in sliding relationship therein.

5. The invention as set forth in claim 4 wherein both said first and second pistons have concave openings in faces which are opposed to each other, said openings defining the said chamber.

6. The invention as set forth in claim 1 where the areas $A_s$ and $A_p$ are in the ratio such that the following relationship is satisfied:

$$A_s/A_p \doteq 1.2\pi$$

7. The invention as set forth in claim 1 including means for circulating said hydraulic fluid through said chamber whereby to assist in cooling said hydraulic spring.

8. The invention as set forth in claim 1 further comprising a block of low stiffness material, a coupling member, said coupling member being disposed at the end of said housing and being adapted to engage said pile, said block being disposed between said second piston and said coupling member.

9. The invention as set forth in claim 8 wherein said block material is selected from wood and aluminum.

10. The invention as set forth in claim 1 further comprising bearing means in said housing in which said pistons are disposed in sliding relationship.

11. The invention as set forth in claim 10 including means for circulating hydraulic fluid in said bearing means.

12. In an impactor having a housing, a tool mounted in said housing which is adapted to deliver blows to a formation, an impacting member mounted for reciprocating movement in said housing with means for repetitively driving said impacting member in forward and return strokes toward and away from said tool, apparatus which permits the weight of the impacting member to be reduced, the velocity of the impacting member to be increased and the driving power applied to the tool, expressed as the product of the blow energy and repetition frequency of the impacting member, to be increased without increasing the force tending to lift the housing off the formation during the downward acceleration of said impacting member, sad apparatus comprising a hydraulic spring-transformer disposed in said housing between said impacting member and said tool for receiving repetitive impacts from said impacting member and transferring force pulses due to said impacts to said tool and for transforming the higher impact velocity of said impacting member to a lower impact velocity as impacted to said tool, said hydraulic transformer comprising a first piston and second piston which define a variable volume chamber, said chamber containing hydraulic fluid and providing said hydraulic spring, said first piston being disposed adjacent said impacting member for receiving said impacts therefrom and said second piston being disposed between said first piston and said tool for transferring said impacts received from said first piston via said hydraulic spring to said tool, said chamber having such a volume that the Q of said spring, loaded by the impedance $R_{AP}$ of the tool when engaging the formation, is less than about 1 where $$Q = R_{AP}\omega_p C,$$

and $$R_{AP} = (P_L c_L A_L / A_S^2)$$

where $P_L$ is the density of the tool, $c_L$ is the velocity of sound in the tool, $A_L$ is the area presented by the tool to the housing, and $A_S$ is the said area presented by said second piston to said chamber, $\omega_p$ is the resonant frequency in radians per second when the mass of the housing and ram are in resonance with the hydraulic spring, $$C = V/B,$$

where V is the volume of the chamber and B is the bulk modulus of the hydraulic fluid in the chamber, and $$\omega_p^2 = (B/V)(A_p^2/M_R)[1 + (M_R/M_H)(A_s/A_p - 1)^2]$$

where $A_p$ is said area presented by said first piston to said chamber, $M_R$ is the mass of the impacting member and $M_H$ is the mass of the housing.

13. The invention as set forth in claim 12 wherein the area of said first piston in a plane perpendicular to the direction of transmission of said force pulses presented to said chamber is less than the area in said plane presented to said chamber by said second piston.

14. The invention as set forth in claim 12 where the areas $A_s$ and $A_p$ are in the ratio such that the following relationship is satisfied:

$$A_s/A_p \doteq 1.2\pi.$$

* * * * *